US005915539A

United States Patent [19]

Lack

[11] Patent Number: 5,915,539

[45] Date of Patent: Jun. 29, 1999

[54] CONDITION INDICATING HARD HAT

[76] Inventor: Bobby Ray Lack, 668 Harlan Ave., Hermleigh, Tex. 79526

[21] Appl. No.: 09/174,336

[22] Filed: Oct. 19, 1998

[51] Int. Cl.[6] ..... A42B 3/00

[52] U.S. Cl. ..... 2/422; 2/209.13; 40/329

[58] Field of Search ..... 2/410, 411, 416, 2/422, 209.13, 195.1; 40/329, 586

[56] References Cited

U.S. PATENT DOCUMENTS 2,796,680 6/1957 Wittcoff ..... 2/209.13
4,667,274 5/1987 Daniel ..... 2/209.13
5,452,479 9/1995 Mostert ..... 2/195.1
5,810,467 9/1998 Hurwitz ..... 2/422

*Primary Examiner*—Michael A. Neas
*Attorney, Agent, or Firm*—Stephen R. Greiner

[57] ABSTRACT

A hard hat including a rigid shell with a channel therein. A plate is secured to the shell so as to cover one of the ends of the channel. A colored indicator is affixed within the channel at the end thereof not covered by the plate. The shutter of a movable slide is positioned within the channel. The shutter can be selectively moved from a retracted position beneath the plate wherein the colored indicator is observable to an extended position wherein the colored indicator is covered by the shutter and is not observable.

15 Claims, 1 Drawing Sheet

CONDITION INDICATING HARD HAT

FIELD OF THE INVENTION

The present invention relates generally to apparel and, in particular, a head cover combined with a diverse art device.

BACKGROUND OF THE INVENTION

Under the Occupational Safety and Health Act (OSHA), employers are required to furnish to their employees a work place free from hazards likely to cause serious physical harm or death. To satisfy this requirement, employers must mark physical hazards, provide personal protective equipment, and teach employees how to perform tasks without accident. Similarly, OSHA requires employees to acquire the knowledge necessary to work safely.

From the view of an employer, it is often difficult to learn whether an employee is cognizant of the dangers associated with a given task or the precautions such dangers require. Of course, an employer could interrogate each employee before a new task is performed or a new work place is entered. Such a process, however, may be unnecessarily time consuming and destructive to employee morale. A need, therefore, exists for an indicator that may be easily used by an employee to alert his employer and fellow employees that the dangers of a particular task are understood and that appropriate action has and will be taken to minimize the possibility of harm.

SUMMARY OF THE INVENTION

In many industrial settings, personal prospective equipment in the form of a hard hat must be worn by employees during the routine course of their work. By donning the hard hat, an employee signals to others that he understands that a head covering is necessary for his own safety. It is a principal object of the present invention to place colored indicators on the hard hat to visually communicate to others that their safety is also being considered.

Certain colors have an accepted meaning under OSHA. Red, for example, is the basic color for marking dangerous locations and the presence of flammable fluids. On the other hand, yellow is the basic color for designating caution and the presence of striking, falling or tripping hazards. Finally, green is the basic color for designating a safe environment. When an employee selectively displays one of these colors with a hard hat constructed in accordance with the present invention, he indicates to his employer and fellow employees that a task may pose dangers for which appropriate precautions are required by all nearby observers.

Briefly, the hard hat constructed in accordance with this invention features a rigid shell with a channel therein. A plate is secured to the shell so as to cover one end of the channel. A colored indicator is affixed within the channel at the end not covered by the plate. The shutter of a movable slide is positioned within the channel. The shutter can be selectively moved from a retracted position beneath the plate wherein the colored indicator is observable to an extended position wherein the colored indicator is covered by the shutter and is not observable.

It is an object of the invention to provide improved elements and arrangements thereof in a hard hat having the features described which is lightweight in construction, inexpensive in manufacture, and dependable in use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
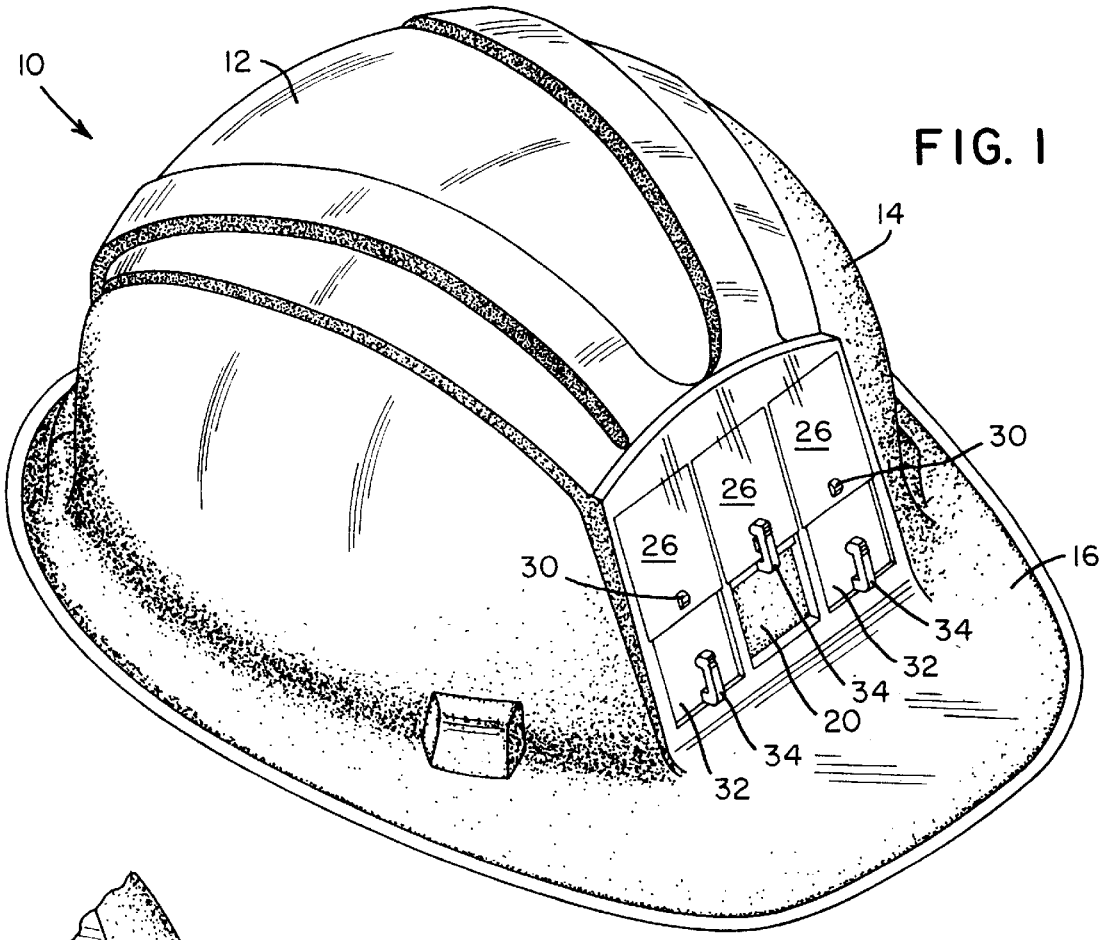
FIG. 1 is a perspective view of a condition indicating hard hat in accordance with the present invention.
Figure 2:
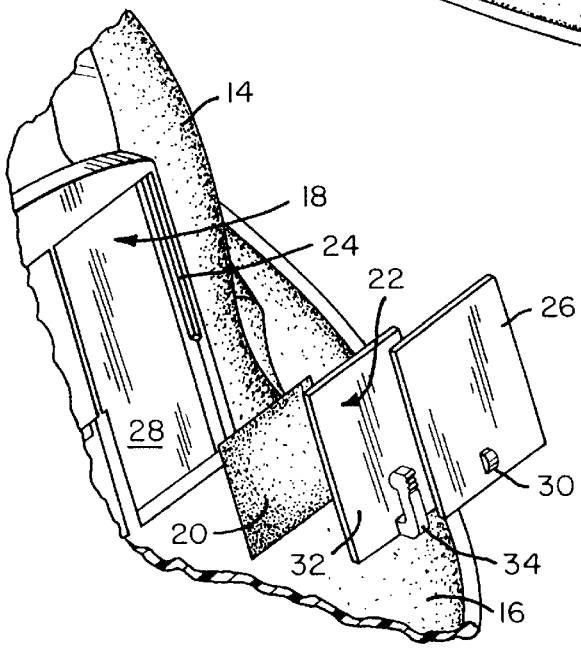
FIG. 2 is an enlarged portion of FIG. 1.

Referring now to the FIGS., a hard hat in accordance with the present invention is shown at 10. The hard hat 10 includes a rigid shell 12 formed of impact-resistant plastic and an attached liner 14 for supporting the shell on a user's head. The shell 12 has a bowl 14 for covering the top of a user's head and a brim 16 extending outwardly from the rim of the bowl. Above the brim 16, the bowl 14 is provided with three, like channels 18 each containing a colored indicator 20. Secured in the channels 20 are slides 22 which may be manually moved by a user to selectively expose one of the colored indicators 20 to the view of a nearby observer.

The channels 18 are molded into the bowl 14 and are rectangular in outline. Each of the channels 18 measures approximately two inches (5 cm) from top to bottom, one inch (2.5 cm) from side to side, and one-eighth inch (0.3 cm) from front to back. The top portion of each channel 18 is provided with a recessed flange 24 for holding a slide-retaining plate 26 at a fixed distance, about one-sixteenth inch (0.15 cm), from the back wall 28 of a channel 18.

Each slide-retaining plate 26 is molded from plastic and is secured within a respective one of the channels 18 by means of a suitable adhesive applied to an associated flange 24. Preferably, each plate 26 is about one and one-half inches (3.8 cm) tall, one and one-eighth inches (2.9 cm) wide, one-sixteenth inch (0.15 cm) thick and has a small keeper 30 projecting from its bottom end. When the plates 26 are secured in place, the bowl 14 is provided with three "sockets" within which portions of the slides 22 are retained and three open "windows," measuring about one inch by one inch (2.5 cm×2.5 cm), at the bottom of the "sockets" into which portions of the slides may be selectively extended.

Colored indicators 20, being self-adhesive decals, are affixed to the back walls 28 of the channels 18 so as to be fully visible through each open "window." Preferably, one indicator 20 is red in color while the other two indicators 20 are yellow and green respectively. So that the indicators 20 may be most easily seen by nearby observers, each measures about one inch by one inch (2.5 cm×2.5 cm).

Each slide 22 includes a shutter 32 formed of an opaque and resilient plastic. The shutter 32 is a rectangular plate having a top-to-bottom length which is about one half of that of the channel 18. The side-to-side and front-to-back length of each shutter 32 are slightly less than those of each channel 18 for a sliding fit.

Figure 3:
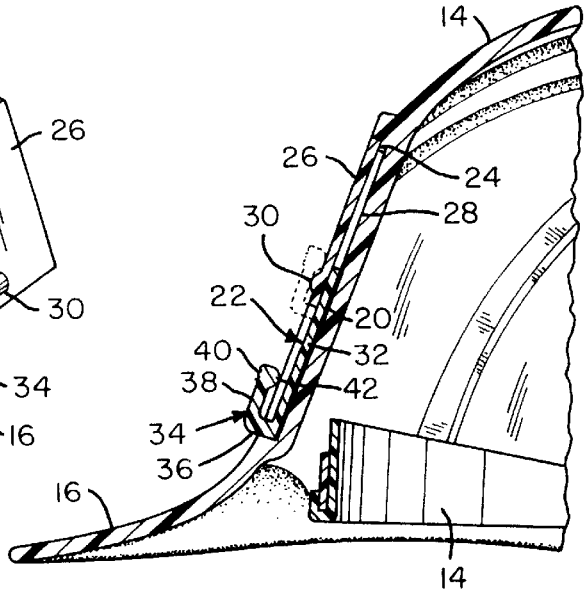
FIG. 3 is a cross-sectional view of the condition indicating hard hat.

A manipulator arm 34 is integrally formed with each shutter—and extends from the bottom end thereof. Each arm 34 is L-shaped and includes a forwardly-extending segment 36 oriented at right angles to its associated shutter 32 and an upwardly-extending segment 38 oriented parallel to the shutter. The free end of each upwardly-extending segment 38 is provided on its front side with a textured gripping surface 40 on its back side with a retaining tab 42. Each of the arms 34 is dimensioned to permit its retaining tab 42 to be selectively manually positioned against the top surface of an associated keeper 30 as shown by broken lines in FIG. 3.

By pushing upwardly on an arm 34 with a finger engaged with the gripping surface 40, an attached shutter 32 in an initially lowered position may be elevated into a "socket"

thereby exposing an indicator 20 to view through a now-open "window." Continued upward pushing with a light force on the arm 34 will drive the associated retaining tab 42 past a keeper 30. With the tab 42 positioned against the top surface of the keeper 30, the shutter 32 is prevented from covering the indicator 20 in the same channel 18. Thus, a nearby observer would be able to see a red, yellow or green signal through the "window" and learn from a distance whether any dangers are posed by a work place or whether precautions are required.

The signal emanating from the hard hat 10 may be changed as often as work place conditions require. To do this, a user need only push down on an elevated arm 34 to disengage such from a keeper 30 and move the attached shutter 32 over one indicator 20. Then, another shutter 32 may be elevated to reveal another indicator 20 through an open "window" as described in the previous paragraph. With practice, the process of manipulating the shutters 32 to reveal an appropriate indicator 20 can be accomplished by a user in seconds without removing the hard hat 10 from his head.

While the invention has been described with a high degree of particularity, it will be appreciated by those skilled in the art that modifications may be made thereto. For example, the number and location of the channels and colored indicators may be modified as desired. Further, each of the colored indicators may comprise a patch of paint rather than a self-adhesive decal. Therefore, it is to be understood that the present invention is not limited to the sole embodiment described above, but encompasses any and all embodiments within the scope of the following claims.

I claim:

1. A hard hat, comprising:

a rigid shell having a channel with opposed ends therein;

a plate secured to said shell so as to cover one of said ends of said channel;

a colored indicator affixed within said channel at said end thereof not covered by said plate; and, a slide having a shutter movably positioned within said channel, said shutter being adapted to move from a retracted position beneath said plate wherein said colored indicator is observable to an extended position wherein said colored indicator is covered by said shutter and is not observable.

2. The hard hat according to claim 1 further comprising a liner positioned within, and secured to, said shell for retaining said shell on the head of a user.

3. The hard hat according to claim 1 wherein said colored indicator is a self-adhesive decal.

4. The hard hat according to claim 1 wherein said slide further includes a manipulator arm extending from said shutter for alternatingly moving said shutter between extended and retracted positions to selectively display said colored indicator.

5. The hard hat according to claim 1 further comprising:

a keeper extending from said plate; and, a manipulator arm extending from said shutter for moving said shutter, said manipulator arm having a retaining tab at its free end adapted to catch upon the top of said keeper and selectively retain said slide in a retracted position.

6. A hard hat, comprising:

a rigid shell having a plurality of channels therein, each of said channels having opposed ends;

a plurality of plates secured to said shell, each of said plates covering one of said ends of a respective one of said channels;

a plurality of colored indicators respectively affixed within said channels at said end thereof not covered by one of said plates; and, a plurality of slides each having a shutter movably positioned within a respective one of said channels, each said shutter being adapted to move from a retracted position beneath a respective one of said plates wherein one said colored indicator is observable to an extended position wherein one said colored indicator is covered by said shutter and is not observable.

7. The hard hat according to claim 6 further comprising a liner positioned within, and secured to, said shell for retaining said shell on the head of a user.

8. The hard hat according to claim 6 wherein each of said colored indicators is a self-adhesive decal.

9. The hard hat according to claim 6 wherein each of said slides further includes a manipulator arm extending from said shutter for alternatingly moving said shutter between extended and retracted positions to selectively display said colored indicator.

10. The hard hat according to claim 6 further comprising:

a keeper extending from each of said plates; and, a manipulator arm extending from each of said shutters, said manipulator arm having a retaining tab at its free end adapted to catch upon the top of one said keeper and selectively retain one of said slides in a retracted position.

11. A hard hat, comprising:

a rigid shell formed of impact-resistent plastic, said shell having a bowl for covering the top of the head of a user and a brim extending outwardly from said bowl, said bowl having a plurality of channels located above said brim, each of said channels having opposed ends;

a plurality of plates secured to said shell, each of said plates covering one of said ends of a respective one of said channels;

a plurality of colored indicators respectively affixed within said channels at said end thereof not covered by one of said plates; and, a plurality of slides each having a shutter movably positioned within a respective one of said channels, each said shutter being adapted to move from a retracted position beneath a respective one of said plates wherein one said colored indicator is observable to an extended position wherein one said colored indicator is covered by said shutter and is not observable.

12. The hard hat according to claim 11 further comprising a liner positioned within, and secured to, said bowl for retaining said shell on the head of a user.

13. The hard hat according to claim 11 wherein each of said colored indicators is a self-adhesive decal.

14. The hard hat according to claim 11 wherein each of said slides further includes a manipulator arm extending from said shutter for alternatingly moving said shutter between extended and retracted positions to selectively display said colored indicator.

15. The hard hat according to claim 11 further comprising:

a keeper extending from each of said plates; and, a manipulator arm extending from each of said shutters, said manipulator arm having a retaining tab at its free end adapted to catch upon the top of one said keeper and selectively retain one of said slides in a retracted position.

* * * * *